United States Patent [19]

Lim

[11] Patent Number: 4,692,664

[45] Date of Patent: Sep. 8, 1987

[54] GASEOUS DISCHARGE DEVICE

[75] Inventor: Gnian C. Lim, Los Angeles, Calif.

[73] Assignee: Amada Engineering & Service Co., Inc., La Mirada, Calif.

[21] Appl. No.: 775,336

[22] Filed: Sep. 12, 1985

[51] Int. Cl.[4] ..... H01J 7/44

[52] U.S. Cl. ..... 315/60; 315/61; 315/335; 315/337; 372/81; 372/86

[58] Field of Search ..... 315/60, 61, 335, 337; 372/81, 87, 86

[56] References Cited

U.S. PATENT DOCUMENTS

| | | | |
|---|---|---|---|
| 2,351,254 | 6/1944 | Elmendorf | 315/335 |
| 2,508,114 | 5/1950 | Jenne | 315/335 |
| 2,544,513 | 3/1951 | Stutsman | 315/335 |
| 3,775,641 | 11/1973 | Goldberg | 315/335 |
| 3,792,372 | 2/1974 | Mark | 315/335 |
| 4,064,416 | 12/1977 | Krense et al. | 315/60 |

*Primary Examiner*—Harold Dixon

*Attorney, Agent, or Firm*—Wigman & Cohen

[57] ABSTRACT

In order to facilitate the initiation of plasma discharge inside a gaseous discharge tube, some form of pre-ionizing the gas is required. This invention describes a technique whereby a small but intense discharge region is created near the cathode of a d.c. discharge in order to generate the necessary electrons to initiate the formation of the main electrical discharge. It makes use of the high negative voltage that is applied on the discharge cathode with respect to the discharge anode. A third auxiliary pin electrode near the cathode is introduced into the discharge tube. It is connected on the outside to the anode through a resistor of a suitable value. In the presence of a high voltage across the main electrodes, corona discharge occurs near the auxiliary electrode. This leads to the formation of a small region of intense discharge between it and the cathode. The electron generated in this small discharge region would drift towards the anode under the high electric field between the main electrodes. The whole discharge volume would therefore be filled with energetic electrons and hence leads to the easy initiation of the main plasma discharge.

4 Claims, 4 Drawing Figures

GASEOUS DISCHARGE DEVICE

BACKGROUND OF THE INVENTION

The present invention relates to an electrical gaseous discharge device for pumping a laser medium, and more particularly to an electrical gaseous discharge device having an auxiliary electrode or pre-ionizing the gas medium in the vicinity of the main cathode to initiate the plasma discharge inside the gaseous discharge tube.

Various lasers use electrical gaseous discharge as the means of pumping the laser medium in order to achieve population inversion. In order to obtain high laser power output, moderately high discharge gas pressure is used. Typically, for continuous wave operation of a $CO_2$ laser, the gas pressure is in the region of 25 torr to 750 torr (atmospheric pressure). The TEA (Transverse Exited Atmospheric), and Excimer lasers operate at about one to ten atmospheric pressures. Many of the solid state lasers such as YAG, glass, GGG and Alexandrite lasers are pumped by the photons generated from Krypton or Xenon flash lamps filled to a pressure of one to five atmospheres.

One of the problems encountered with high pressure gaseous discharge is the initialization of the discharge itself. In order to start up a discharge, i.e., cause an electrical current to flow from one electrode (anode) to the other (cathode) through the gas medium, there must be present in the gas medium enough electrons to carry the current. Under normal (room) conditions of temperature and cosmic radiation, only an extremely small quantity of electrons is present in the gas medium. As a result, a voltage as high as two to five times the normal operating value is required to apply between the anode and cathode in order to provide an electric field high enough to break down the gas molecules and hence increase the electron density between the electrodes. As the electron density increases, the ionization rate of the gas molecules also increases, eventually leading to a self-sustained discharge. Since the value of the high striking voltage necessary to initiate the discharge is not a well defined one, such method leads to inconsistency in discharge plasma initialization. The problem becomes more and more serious as the gas pressure and discharge length are increased.

Another drawback of using high striking voltage to initiate a plasma discharge is the unavoidable high current spike that immediately follows at the on-set of the discharge. This high current spike may not be a desirable feature as it may lead to the following effects:

(a) Degradation of the discharge electrodes due to the high electric field.

(b) Degradation of the discharge gas due to chemical dissociation of the molecules.

(c) The laser beam will exhibit gain-switching effect, producing an initial high beam power spike with poor spatial mode profile.

Several techniques have been used conventionally in order to pre-ionize the gas medium before the main discharge voltage is applied. One of these techniques involved the generation of a small volume of discharge plasma near the main discharge anode electrode. This requires an addition of a high voltage power supply, and hence added cost. Both ac and dc power supply had been used for this purpose.

Other techniques that had been used for pre-ionization relied on the ionization effect of external radiations such as ultra-violet (UV) light, x-ray and electron beam.

Again, additional equipment is needed to serve the purpose.

Accordingly, one of the objects of the present invention is to provide a gaseous discharge device capable of generating a high electric field over a small region inside a gaseous d.c. discharge tube near the main discharge cathode in order to facilitate the initialization of the main discharge.

Another object is to provide an electrical circuit such that the main plasma discharge can be started without the undesirable high current spike.

Still another object of the present invention is to provide a gaseous discharge device of making use of the main discharge d.c. power supply for the generation of such a small region of discharge so that no additional power supply is required.

A further object of the present invention is to provide a gaseous discharge device capable of generating the main d.c. discharge with an initialization discharge region whose intensity increases with increase in the main plasama discharge current for better main discharge stability.

Still a further object of the present invention is to provide a gaseous discharge device capable of a better pre-ionization of the gas so as to ensure a better consistency in discharge characteristics from one discharge pulse to the other when the discharge is operating in a pulsing mode.

SUMMARY OF THE INVENTION

The present invention discloses an electrical gaseous discharge device having, in the vicinity of the main cathode, an auxiliary electrode for pre-ionizing the gas medium. The auxiliary electrode is pin-shaped, and having a sharp end inside the discharge tube and, on the outside of the discharge tube, the main anode is connected through a resistor. In the presence of a high voltage across the main electrodes, corona discharge occurs near the auxiliary electrode. This leads to the formation of a small region of intense discharge between the auxiliary electrode and the main cathode. The electron generated in this small discharge region would drift towards the main anode under the high electric field between the main electrodes. The whole discharge tube would therefore be filled with energetic electrons and hence leads to the easy initiation of the main plasma discharge. As set forth above, a newly hired third electrode as an auxiliary electrode effectively works for pre-ionization of the gaseous laser medium so as to lead the main plasma discharge between the main electrodes, without requiring any additional equipment.

A capacitor is preferably placed across the resistor in order to provide an even better pre-ionization start up.

DETAILED DESCRIPTION OF THE PREFERRED EMBODIMENTS OF THE INVENTION

Figure 1:
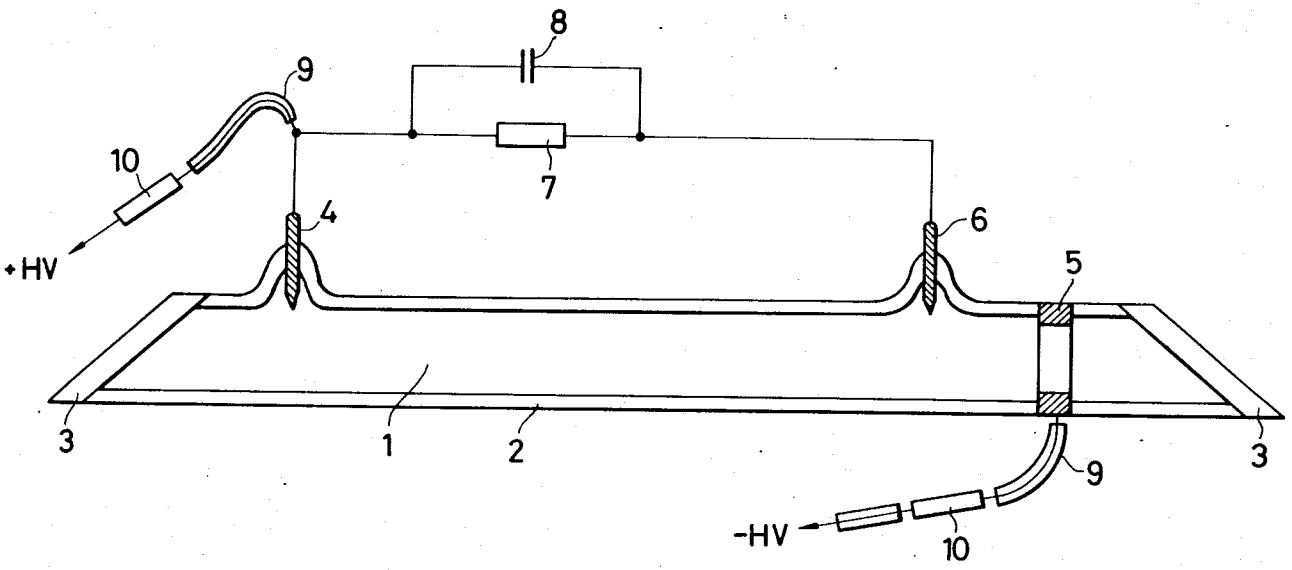
FIG. 1 is a longitudinal sectional view of one embodiment of the device of the present invention showing the electrical connection among the electrodes and the power supply.
Figure 2:
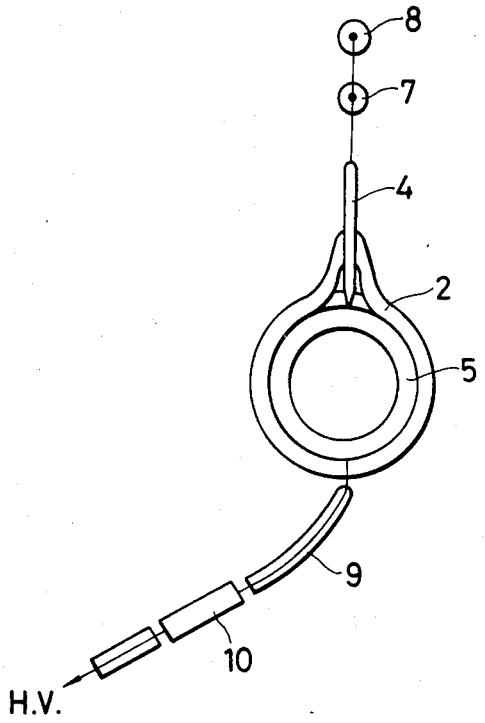
FIG. 2 is a cross sectional view of said one embodiment.

Referring to FIGS. 1 and 2, the gas 1 of the laser medium is enclosed within the discharge tube 2 by the Brewster window 3 at each end thereof. The main anode 4 is pin-shaped and the main cathode 5 in the form of a cylindrical ring are provided on the tube 2 in the vicinity of both ends thereof, respectively. In the vicinity of the main discharge cathode, the auxiliary electrode 6 is pin-shaped and is provided on the tube 2 with the sharp end thereof located inside the tube 2. The distance of the auxiliary electrode 6 from the main cathode 5 is preferably about one-sixth the length of the main anode-cathode separation. On the outside of the tube, the auxiliary electrode 6 is connected to the main anode through a resistor 7 of a suitable value. A capacitor 8 is also connected across the resistor 7.

The main discharge anode 4 is connected with a high voltage cable 9 via a ballast resistor 10 to the positive terminal of the power supply. The main discharge cathode 9 is similarly connected to the negative terminal of the power supply. Normally, only one of the ballast resistors 10, 10 is needed. Also, the form of the main cathode 5 is not restricted to the ring-shaped one. It is transformable depending on the actual design and purpose of the discharge tube.

Let V be the value of the operating voltage across the main electrodes 4 and 5, and let t be the rise time of this voltage from the power supply. Further, let I be the discharge current. Then, the value of resistor 7 should be such that $$R \simeq V/BI \text{ (Ohm)}$$

where B takes the value from 0.01 to 0.05.

The value of the capacitor 8 should be such that $$C \simeq 10t\ I/V \text{ (Farad.)}$$

Figure 3:
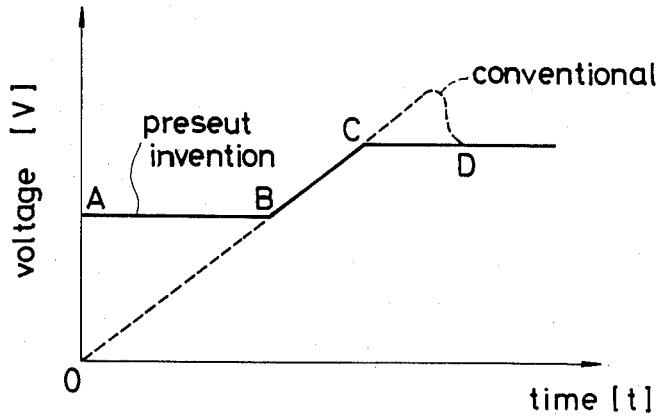
FIG. 3 is a graph showing the time transition of the voltage between the main electrodes on said embodiment, comparing with the same of the conventional device.

Referring to FIG. 1, upon the application of a high voltage across the electrodes 4 and 5, but prior to the formation of a gas plasma inside the tube, the gas impedence is very high due to the virtual absence of free electrons in the gas 1. The presence of the capacitor 8 and the very high impedence between the cathode 5 and auxiliary electrode 6 results in a full voltage being applied across these electrodes 5 and 6. A very high electric field is therefore generated in the region around the sharp end of the auxiliary electrode 6. Corona discharge therefore occurs immediately at this region and so leads to the formation of a self-sustained plasma discharge between electrodes 5 and 6 inside the discharge tube 2. (See FIG. 3, Section A-B.) Thereafter, resistor 7 acts as a ballast to limit the magnitude of this pre-ionization current. The voltage on the pin electrode 6 with respect to the cathode 5 would then decrease to a value just enough to support the discharge between them. Some of the electrons generated by the breakdown (discharge) of the gas in said region between the electrodes 5 and 6 will be accelerated towards the anode 4 under the high electric field between the anode 4 and cathode 5. (See FIG. 3, Section B-C.) This high electric field is due to the high positive voltage on the anode 4 with respect to the cathode 5. The whole region of the gas 1 between the electrodes 4 and 5 is hence filled with energetic electrons. Ionization of the gas 1 would therefore occur easily due to the collision of the said energetic electrons with the gas molecules. (See FIG. 3, Section C-D.)

Figure 4:
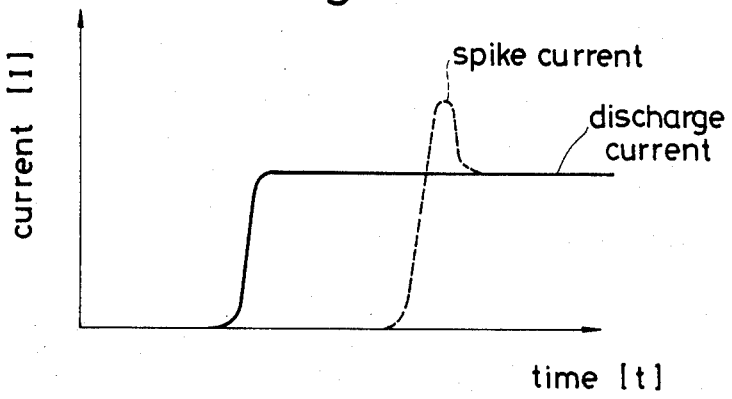
FIG. 4 is a graph showing the time transition of the discharge current flowing through the main electrodes, comparing with the same of the conventional device.

With this design, a stand-by voltage can be applied across the main electrodes 4 and 5 in such a way that only a pre-ionization discharge occurs between the auxiliary electrode 6 and the main cathode 5. Then, the discharge between the main electrodes 4 and 5 can be brought up smoothly without the occurrence of a high current spike as seen in the conventional device. (See FIG. 4.)

The above description is of a preferred embodiment of the present invention and many modifications may be made thereof without departing from the spirit and scope of the invention which is defined in the appended claims.

What I claim is:

1. A gaseous discharge device comprising:
   - a discharge tube enclosing lasing gas medium therein;
   - a pin-shaped main discharge anode whose sharp end projects inside said discharge tube and a cylindrical ring main discharge cathode mounted along the inner circumference of and inside said discharge tube; and
   - a pin-shaped auxiliary electrode, the sharp end of which projects inside said discharge tube, located in the immediate vicinity of said main discharge cathode, wherein said main discharge anode is electrically connected to a positive terminal of a high voltage power supply and said main discharge cathode is connected to a negative terminal of said power supply, and said auxiliary electrode is electrically connected to said main discharge anode through a resistor and a capacitor which are connected in parallel to each other, wherein the resistance value of the resistor is $R=V/BI$ and the capacitance value of the capacitor is $C=10tI/V$, in which V is an operating discharge voltage applied across the main anode and main cathode, I is an operating discharge current, t is a rise time of said voltage V from the power supply, and B is a value from 0.01 to 0.05.

2. The gaseous discharge device of claim 1, wherein said auxiliary electrode ionizes a gas medium when a main discharge occurs between said main discharge anode and said main discharge cathode.

3. The gaseous discharge device of claim 1 wherein the axes of the main discharge anode and the auxiliary electrode are perpendicular to the longitudinal axis of the discharge tube.

4. The gaseous discharge device of claim 1 wherein the distance of the auxiliary electrode from the main discharge cathode is about one-sixth the length of the separation between the main discharge anode and main discharge cathode.

* * * * *